US007744477B2

(12) United States Patent
Cook

(10) Patent No.: US 7,744,477 B2
(45) Date of Patent: Jun. 29, 2010

(54) BANK SHOT GUIDE FOR BILLIARDS

(76) Inventor: Sam Cook, 2930 Long Rifle Dr., Wimauma, FL (US) 33598

( * ) Notice: Subject to any disclaimer, the term of this patent is extended or adjusted under 35 U.S.C. 154(b) by 166 days.

(21) Appl. No.: 12/149,154

(22) Filed: Apr. 28, 2008

(65) Prior Publication Data

US 2008/0268972 A1 Oct. 30, 2008

Related U.S. Application Data

(60) Provisional application No. 60/924,062, filed on Apr. 27, 2007.

(51) Int. Cl.
*A63D 15/00* (2006.01)
*A63D 15/08* (2006.01)

(52) U.S. Cl. ..... 473/2; 473/44; 473/1

(58) Field of Classification Search ..... 473/2, 473/44, 46, 31, 49
See application file for complete search history.

(56) References Cited

U.S. PATENT DOCUMENTS

| | | | | | |
|---|---|---|---|---|---|
| 2,537,228 | A | | 1/1951 | Matson | |
| 3,463,593 | A | | 8/1969 | Horan | |
| 4,027,883 | A | | 6/1977 | Batori | |
| 4,082,270 | A | | 4/1978 | Josenhans | |
| 4,949,965 | A | * | 8/1990 | Ross et al. | 473/2 |
| 5,275,398 | A | * | 1/1994 | Compton | 473/2 |
| 5,520,581 | A | | 5/1996 | Mazzoli | |
| 5,558,584 | A | * | 9/1996 | Brown | 473/44 |
| D378,393 | S | | 3/1997 | Marshall et al. | |
| 5,704,842 | A | * | 1/1998 | Petrusek | 473/44 |
| 5,873,787 | A | * | 2/1999 | Colak | 473/2 |
| 5,919,095 | A | | 7/1999 | Risner | |
| 6,699,136 | B2 | * | 3/2004 | Kuo | 473/44 |
| 6,875,120 | B1 | | 4/2005 | Ellis | |
| 6,929,554 | B1 | * | 8/2005 | Wheeler, Jr. | 473/2 |
| 6,942,576 | B2 | | 9/2005 | Holt | |
| 7,144,328 | B1 | | 12/2006 | Ellis | |
| 2005/0107176 | A1 | | 5/2005 | Holt | |
| 2006/0030417 | A1 | * | 2/2006 | Evans et al. | 473/44 |
| 2006/0030418 | A1 | * | 2/2006 | Evans et al. | 473/44 |
| 2008/0220887 | A1 | * | 9/2008 | Evans et al. | 473/2 |

OTHER PUBLICATIONS

Muller Recreational Products catalog 2002, p. 62-190 MC36 Ramin Cue.*

Henry Bros.—Billiard and Pool Table Supplies, Complete Catalog, dated Aug. 1, 1922, p. 8, Henbro Billiard Cues No. 10.*

* cited by examiner

*Primary Examiner*—Mitra Aryanpour
(74) *Attorney, Agent, or Firm*—Richard C. Litman

(57) ABSTRACT

The bank shot guide for billiards has at least one visible marking which may be disposed on a pool cue shaft, tape measure, floor, or floor accessory adapted to be easily observable by the shooter while setting up a pool shot on a pool table. The markings can be aligned along the length of the pool cue shaft, tape measure, floor, or floor accessory at predetermined distances to provide graphical symbols that can aid a player in calculating bank angle game parameters applicable to the game table being played on. The markings are designed to represent extensions of readily observable existing diamond markings typically located on the pool table side rails. Groups of the markings may be color coded and/or rotationally separated from each other to visibly display the appropriate group of markings applicable to a particular length of pool table being used.

15 Claims, 3 Drawing Sheets

BANK SHOT GUIDE FOR BILLIARDS

CROSS-REFERENCE TO RELATED APPLICATION

This application claims the benefit of U.S. Provisional Patent Application Ser. No. 60/924,062, filed Apr. 27, 2007.

BACKGROUND OF THE INVENTION

1. Field of the Invention

The present invention relates to a bank shot guide including a pool cue stick and more particularly to a bank shot guide including a pool cue stick, a floor accessory, or a tape measure, each having one or more visible markings disposed thereon which are extensions of the rail markings found on pool tables, billiard tables, carom tables, or the like.

2. Description of the Related Art

Games, such as billiards, pool, snooker, carom, or the like use a cue stick and are played on a table bounded by elastic rails. Such table games using a cue stick are hereinafter, referred to collectively as "billiards" or "pool". During billiards play, it is frequently necessary or desirable to direct the cue ball or an object ball into one or more rails to redirect the ball toward its intended target. When the ball directed into the rail is an object ball, the shot is known as a bank shot. When the ball directed into the rail is the cue ball, the shot is known as a kick shot.

Utilizing known principles of physics and geometry relating to particle collisions, it can be shown that a billiard ball will rebound from the rail at or near the same angle that it approaches the rail. However, the exact rebound angle is dependent upon the properties of the rail, the velocity of the ball, and any spin possessed by the ball as it strikes the rail.

Bank and kick shots, which may be referred to collectively as "bank shots", are among the most difficult billiard shots to master. Consequently, numerous techniques and devices have been devised to train or assist players in executing bank shots. One known method to determine the theoretical point along a rail to aim a bank shot is to mentally calculate and visualize the aim point based on principles of geometry. The evenly spaced markings (for example, "diamond" markings) along the rails of most billiard tables are often used to assist in these mental exercises. Such methods to date, however, have been unsuccessful when the cue ball is on a table position where sight alignment with the rail diamond is not possible due to the finite length of the table. It would be desirable to extend the alignment diamonds beyond the playing table.

Thus, a bank shot guide for billiards solving the aforementioned problems is desired.

SUMMARY OF THE INVENTION

The bank shot guide for billiards is a system in which at least one visible marking may be disposed on a pool cue shaft or other elongate rigid member, tape measure; floor, or floor accessory adapted to be easily observable by the shooter while setting up a pool shot on a pool table. The markings can be aligned along the length of the pool cue shaft, tape measure, floor, or floor accessory at predetermined distances to provide graphical symbols that can aid a player in calculating bank angle game parameters applicable to the game table being played on. The markings are designed to represent extensions of readily observable existing diamond markings typically located on the pool table side rails. The markings may additionally have decorative or commercial uses. Groups of the markings may be color coded and/or rotationally separated from each other to indicate their compatibility with a particular length of pool table.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
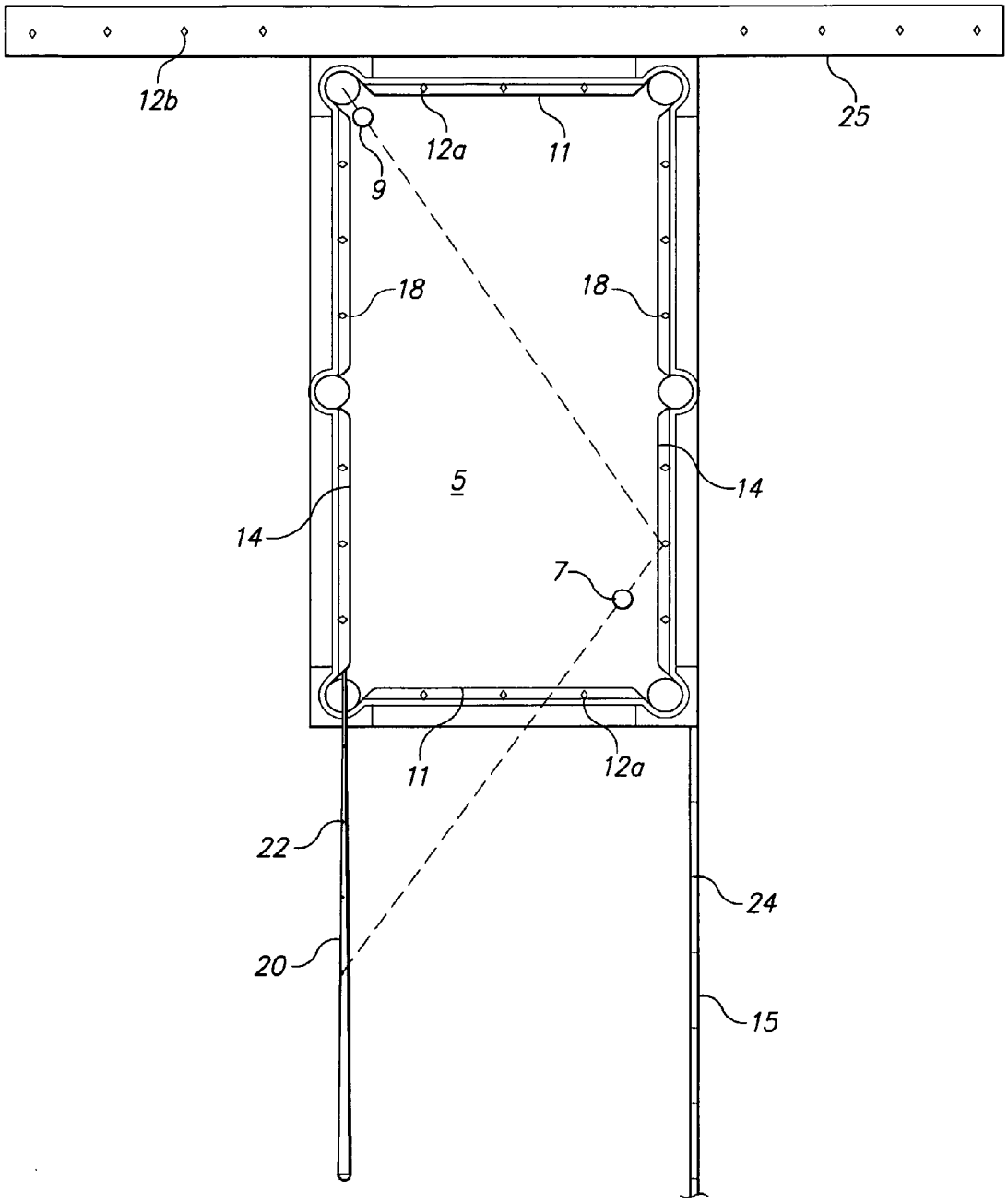
FIG. 1 is an environmental, top view of a bank shot guide for billiards according to the present invention.

The present invention, as shown in FIG. 1, is a system in which at least one visible marking may be disposed on a pool cue shaft 20 or other elongate rigid member, tape measure 15, floor, or floor accessory 25 adapted to be easily observable by the shooter while setting up a pool shot on a pool table 5.

Markings 22 can be aligned along the length of the pool cue shaft 20. Similarly, markings 24 can be aligned along the length of tape in tape measure 15. Moreover, markings 12*b* can be aligned along a floor, or floor accessory, such as floor runner 25. Markings 22 on cue stick 20, markings 24 on tape measure 15, and markings 12*b* on floor runner 25 are disposed at predetermined distances from each other on the object (cue stick 20, tape measure 15, or floor runner 25) to provide graphical symbols that can aid a player in calculating bank angle game parameters applicable to the game table being played on.

The markings are designed to represent extensions of readily observable existing diamond markings located on the game table rails. As shown in FIG. 1, for example, pool table 5 has side rails 14 and diamond markings 18 disposed thereon. Additionally, the pool table 5 has end rails 11 and corresponding diamond markings 12*a* disposed thereon.

Exemplary floor runner 25 has markings 12*b* that extend in both directions beyond end rail 11. The markings 12*b* may be used by a player to sight an aim point that would not have been possible to sight using solely the diamond markings disposed on end rail 11 of pool table 5.

Similarly, exemplary cue stick 20 has markings 22 that can be positioned by the player to extend beyond the rail being sighted. In the example shown, the extension of the diamonds 18 is provided by laying cue stick 20 in line with end of one of the side rails 14. The markings 22 may be used by the player to sight an aim point that would not have been possible to sight using solely the diamond markings disposed on end rail 14 of pool table 5.

Additionally, exemplary tape measure 15 has markings 24 that can be positioned by the player to extend beyond the rail being sighted. In the example shown, the extension of the diamonds 18 is provided by extending tape measure 15 in line with end of one of the side rails 14. The markings 24 may be used by the player to sight an aim point that would not have been possible to sight using solely the diamond markings disposed on end rail 14 of pool table 5.

A sighting example using the cue stick 20, side rail 14, rail diamond markings 18 and cue stick markings 22 is shown in FIG. 1, wherein the player can sight cue ball 7 to determine the optimum position on side rail 14 opposite the player's position (stick position) to aim for a kick shot that sinks object ball 9 into the pocket located on the side rail 14 in line with the diamond extension position of cue stick 20.

It should be understood that the player can mentally calculate and visualize the aim point e.g., bifurcation point, based on principles of geometry to achieve the shot shown and other shot positions that may be presented on table 5. Thus, the evenly spaced diamond markings 12*a* and 18 along corresponding rails 11 and 14 of billiard table 5 can be used in combination with the diamond extension markings 22 on cue stick 20, diamond extension markings 24 on tape measure 15, or alternatively, diamond extension markings 12*b* on floor runner 25 to assist in the mental calculations that a player may utilize during game play.

Figure 2A:
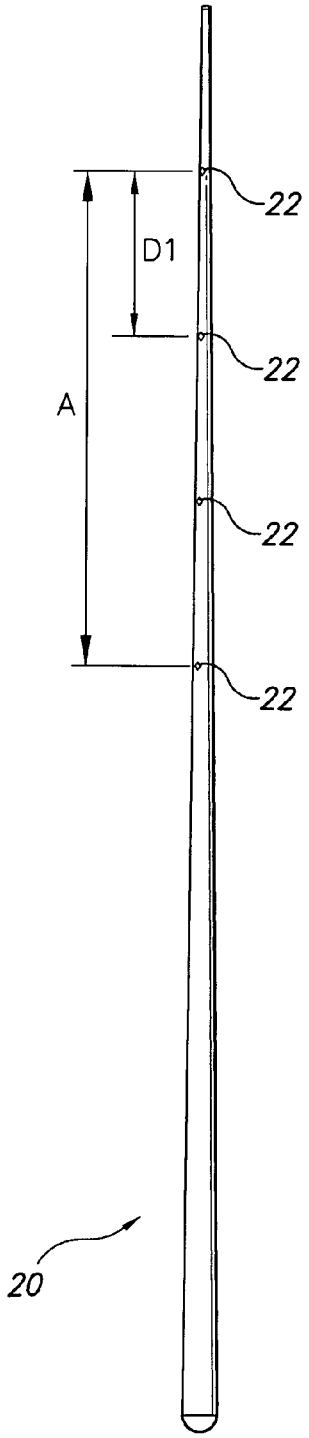
FIG. 2A is a plan view showing a first preferred separation distance of the cue stick markings according to the present invention.
Figure 2B:
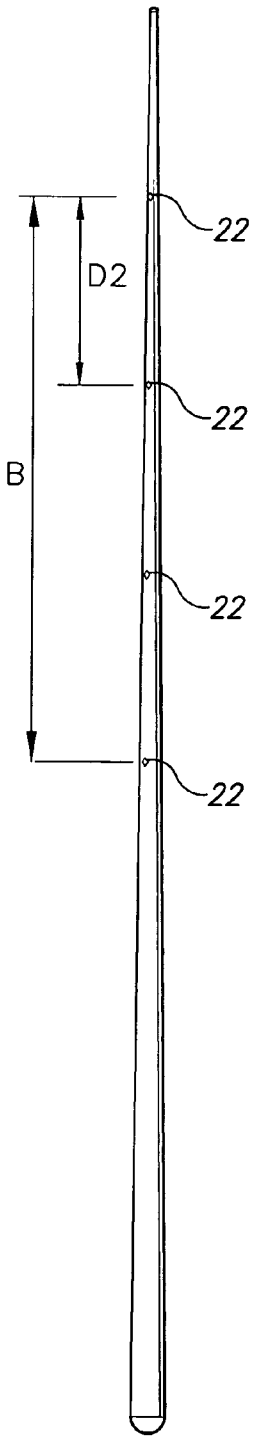
FIG. 2B is a plan view showing a second preferred separation distance of the cue stick markings according to the present invention.
Figure 2C:
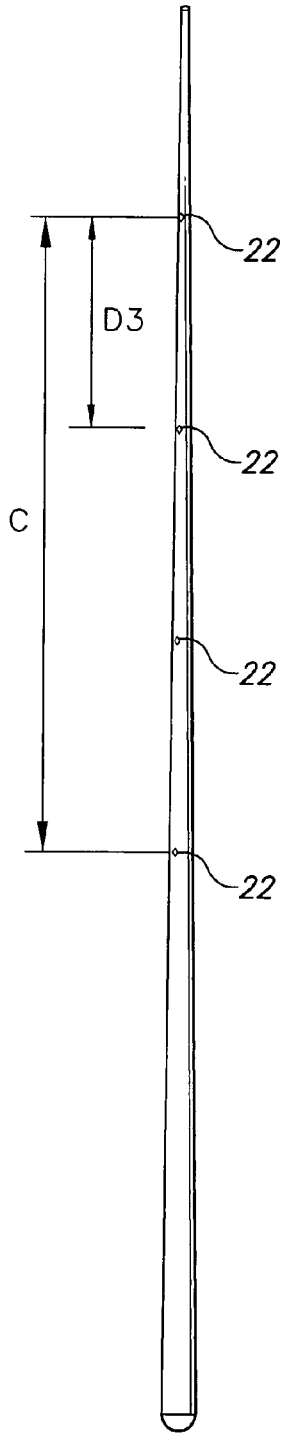
FIG. 2C is a plan view showing a third preferred separation distance of the cue stick markings according to the present invention.

Generally, pool tables such as table 5 are readily available in a 7-foot version, an 8-foot version, and a 9-foot version. The diamond spacing on table 5 is proportional to the size of the table. Thus preferably, the present invention may be provided with extension markings that correctly correspond to the size of the table in play. For example, as shown in FIGS. 2A-2C, cue stick 20 may have diamond extension markings 22 distributed along a total distance A having a separation distance D1, corresponding to the diamond markings found on a 7-foot table. Similarly, cue stick 20 may have diamond extension markings 22 distributed along a total distance B having a separation distance D2, corresponding to the diamond markings found on an 8-foot table. Or, cue stick 20 may have diamond extension markings 22 distributed along a total distance C having a separation distance D3, corresponding to the diamond markings found on a 9-foot table.

Figure 2D:
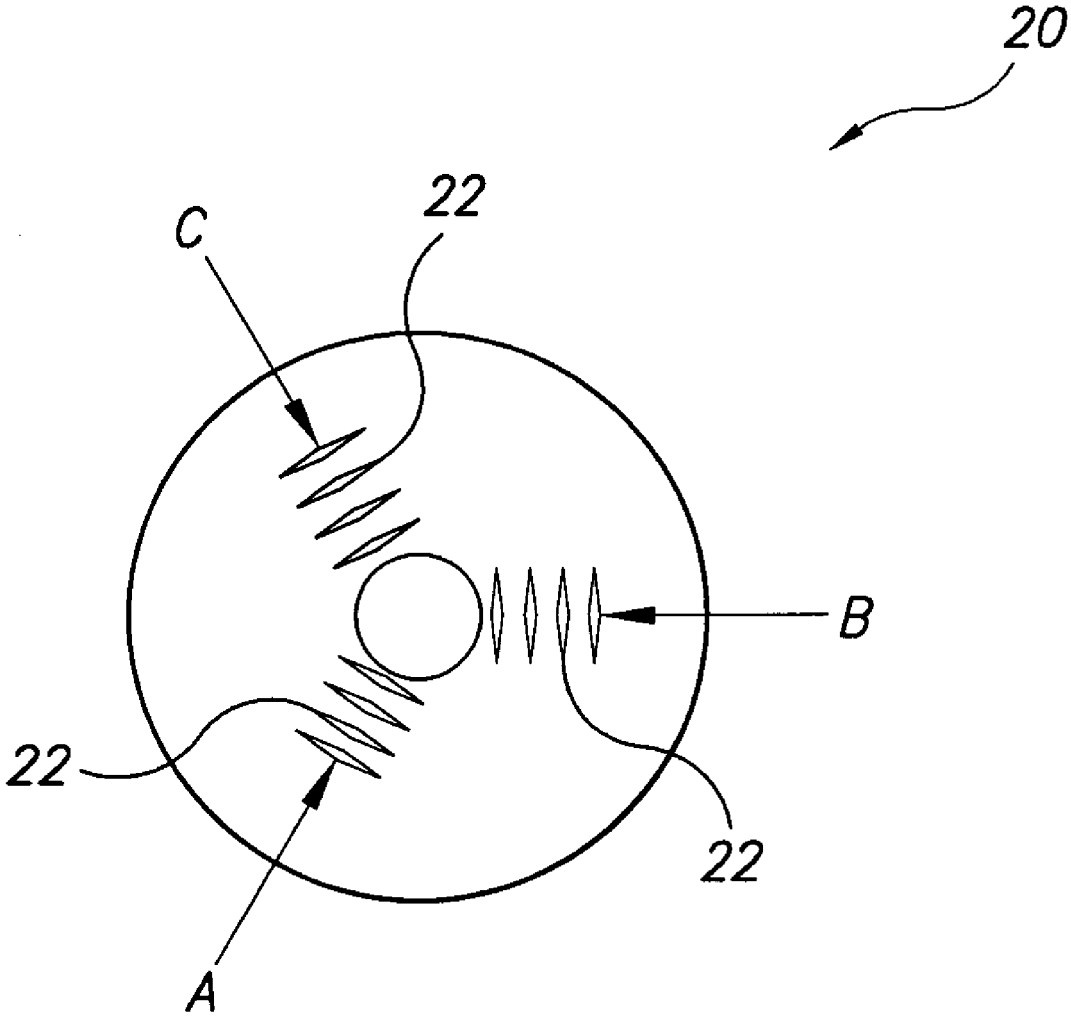
FIG. 2D is an end view of a cue stick showing a rotational relationship between first, second and third set of markings on the cue stick, according to the present invention.

Groups of the markings 22 may be color coded and/or, as shown in FIG. 2D, may be rotationally separated from each other on cue stick 20 so that a player can rotate the stick until the appropriate group of markings 22 applicable to a particular length of pool table is visibly displayed on the cue stick 20.

It is to be understood that the present invention is not limited to the embodiments described above, but encompasses any and all embodiments within the scope of the following claims.

I claim:

1. A pool cue stick for improving bank shots on a game table having two parallel side rails bounded by two parallel end rails, and rail markings disposed at specified intervals on the rails, the pool cue stick comprising:

a shaft having a length, a longitudinal axis, a substantially smooth, continuous exterior surface, a tip end, a distal end, and a ferrule-receiving portion of the pool cue stick proximate the tip end; and a bank shot guide comprising at least four easily observable visible markings disposed longitudinally along the exterior surface, each of the visible markings being located at least one predetermined distance along the exterior surface from another one of the visible markings on the exterior surface, the at least one predetermined distances being equal to each other and equal to the specified intervals of the game table rail markings, wherein a player can position the pool cue to extend beyond the rail being sighted thereby forming an extension of the specified intervals of the game table rail markings by laying cue stick in line with an end of one of the side or end rails whereby the player can sight a cue ball to determine the optimum position on the side or end rails opposite the player's pool cue stick position to aim for a bank shot that strikes an object ball.

2. The pool cue stick according to claim 1, wherein the visible markings are graphical symbols for aiding a player in calculating bank angle game parameters applicable to the game table being played on.

3. The pool cue stick according to claim 1, wherein the visible markings are diamond markings corresponding to rail markings on the game table being used.

4. The pool cue stick according to claim 1, wherein the predetermined distance between the visible markings and the specified intervals of the game table rail markings are proportional to the size of the game table being used.

5. The pool cue stick according to claim 1, wherein the at least four easily observable visible markings disposed longitudinally along the exterior surface comprise a group of visible markings, wherein at least three groups of visible markings are rotationally separately disposed on the exterior surface of the pool cue stick, the separate visible marking groups being respectively associated with a uniquely sized game table.

6. The pool cue stick according to claim 5, wherein groups of the markings are color coded.

7. The pool cue stick according to claim 6, wherein a first group of the color coded markings corresponds to markings found on a 7-foot game table, a second group of the color coded markings corresponds to markings found on an 8-foot game table, and a third group of the color coded markings corresponds to markings found on a 9-foot game table.

8. A bank shot guide system including a pool cue stick and a table for playing a pool game thereon, the table having two parallel side rails bounded by two parallel end rails, and rail markings disposed at specified intervals on the rails, the pool cue stick comprising:

a shaft having a length, a longitudinal axis, a substantially smooth, continuous exterior surface, a tip end, a distal end, and a ferrule-receiving portion of the pool cue stick proximate the tip end; and a bank shot guide comprising at least four easily observable visible markings disposed longitudinally along the exterior surface, each of the visible markings being located at least a predetermined distance along the exterior surface from another one of the visible markings on the exterior surface, the at least one predetermined distances being equal to each other and equal to the specified intervals of the game table rail markings, wherein a player can position the pool cue to extend beyond the rail being sighted thereby forming an extension of the specified intervals of the game table rail markings by laying cue stick in line with an end of one of the side or end rails whereby the player can sight a cue ball to determine the optimum position on the side or end rails opposite the player's pool cue stick position to aim for a bank shot that strikes an object ball.

9. The bank shot guide system according to claim 8, wherein the at least four easily observable visible markings disposed longitudinally along the exterior surface comprise a group of visible markings, wherein at least three groups of visible markings are rotationally separately disposed on the exterior surface of the pool cue stick, the separate visible marking groups being respectively associated with a uniquely sized game table.

10. The bank shot guide system according to claim 9, wherein groups of the markings are color coded.

11. The bank shot guide system according to claim 10, wherein a first group of the color coded markings corresponds to markings found on a 7-foot game table, a second group of the color coded markings corresponds to markings found on an 8-foot game table, and a third group of the color coded markings corresponds to markings found on a 9-foot game table.

12. The bank shot guide system according to claim 8, wherein the visible markings are graphical symbols for aiding a player in calculating bank angle game parameters applicable to the game table being played on.

13. The bank shot guide system according to claim 8, wherein the visible markings are diamond markings corresponding to rail markings on the game table being used.

14. The bank shot guide system according to claim 8, wherein the predetermined distance between the visible markings and the specified intervals of the game table rail markings are proportional to the size of the game table being used.

15. The bank shot guide system according to claim 8, wherein the table has pockets located at the corners and at the midpoint of each side rail.

* * * * *